US005286441A

United States Patent [19]

Shibata

[11] Patent Number: 5,286,441

[45] Date of Patent: Feb. 15, 1994

[54] SILVER-METAL OXIDE COMPOSITE MATERIAL AND PROCESS FOR PRODUCING THE SAME

[75] Inventor: Akira Shibata, 298-45, Takada-cho, Kohoku-ku, Yokohama-shi, Kanagawa-ken, Japan

[73] Assignees: Akira Shibata, Yokohama; Sumico Management Planning Company, Ltd., Tokyo, both of Japan

[21] Appl. No.: 892,751

[22] Filed: Jun. 3, 1992

Related U.S. Application Data

[60] Division of Ser. No. 668,330, Mar. 14, 1991, Pat. No. 5,160,366, which is a continuation-in-part of Ser. No. 633,667, Dec. 26, 1990, abandoned.

[30] Foreign Application Priority Data

Dec. 26, 1989 [JP] Japan ..... 1-338005
Jan. 9, 1990 [JP] Japan ..... 2-2240

[51] Int. Cl.[5] ..... B22F 3/14

[52] U.S. Cl. ..... 419/21; 419/45; 419/46; 419/57; 75/10.4

[58] Field of Search ..... 419/21, 19, 20, 46, 419/45, 47, 57; 75/232, 235, 10.4

[56] References Cited

U.S. PATENT DOCUMENTS

| | | | |
|---|---|---|---|
| Re. 29,986 | 5/1979 | Davies et al. | 75/234 |
| 2,539,298 | 1/1951 | Doty | 428/564 |
| 2,985,532 | 5/1961 | Simon | 75/234 |
| 3,954,459 | 5/1976 | Schreiner et al. | 75/206 |
| 3,969,112 | 7/1976 | Kim et al. | 75/206 |
| 4,092,157 | 5/1978 | Reid et al. | 75/206 |
| 4,098,724 | 7/1978 | Douglas et al. | 252/514 |
| 4,217,139 | 8/1980 | Kim et al. | 75/206 |
| 4,426,356 | 1/1984 | Nair et al. | 419/21 |
| 4,680,162 | 7/1987 | Shibata | 419/21 |
| 4,808,223 | 2/1989 | Ozaki et al. | 75/235 |
| 4,859,238 | 8/1989 | Weise et al. | 75/233 |
| 4,874,430 | 10/1989 | Bornstein | 75/234 |
| 4,892,861 | 1/1990 | Ray | 505/1 |
| 4,909,841 | 3/1990 | Iyer et al. | 75/233 |
| 4,948,424 | 8/1990 | Haufe et al. | 75/234 |
| 4,954,170 | 9/1990 | Fey et al. | 75/229 |
| 4,971,754 | 11/1990 | Fontpt et al. | 419/8 |
| 5,000,909 | 3/1991 | Charles et al. | 419/8 |
| 5,137,867 | 8/1992 | Ray et al. | 505/1 |
| 5,160,366 | 11/1992 | Shibata | 75/232 |

FOREIGN PATENT DOCUMENTS

| | | |
|---|---|---|
| 2754335 | 6/1978 | Fed. Rep. of Germany . |
| 3538684 | 5/1986 | Fed. Rep. of Germany . |
| 2123033 | 1/1984 | United Kingdom . |

*Primary Examiner*—Donald P. Walsh
*Assistant Examiner*—Daniel Jenkins
*Attorney, Agent, or Firm*—Oblon, Spivak, McClelland, Maier & Neustadt

[57] ABSTRACT

A silver-metal oxide composite material comprising a silver matrix, (a) from 1 to 20% by weight, in terms of elemental metal, of an oxide of at least one element selected from the group consisting of Sn, Cd, Zn and In and, optionally, (b) an oxide of Mg, Zr, etc. and/or (c) an oxide of Cd, Sb, etc.; the oxides being dispersed in the form of fine particles with a particle size of not more than about 0.1 μm uniformly and being bound to the silver matrix with no space left, and a process for producing the same. The composite material is excellent in physical and chemical strengths at high temperatures. The process can produce the composite product even with thick walls, within a markedly short time in high productivity. The composite material is useful as electrical contact materials and electrode materials for electric welding.

6 Claims, 1 Drawing Sheet

SILVER-METAL OXIDE COMPOSITE MATERIAL AND PROCESS FOR PRODUCING THE SAME

This is a division of application Ser. No. 07/668,330, filed Mar. 14, 1991, now U.S. Pat. No. 5,160,366, which is a continuation-in-part of application Ser. No. 07/633,667, filed Dec. 26, 1990, now abandoned.

BACKGROUND OF THE INVENTION

1. Field of the Invention

The present invention relates to a silver-metal oxide composite material and process for producing the same, and in particular to a silver-metal oxide composite material suited to electrical contact materials and electrode materials for electric welding and a process for producing it.

2. Description of Prior Art

Silver-metal oxide composite materials prepared by adding a metal oxide such as a tin oxide to silver have a markedly improved strength and therefore are used as an electrical contact material for relays, switches, breakers, and the like for alternating current and direct current, particularly suitably used as electrical switching contact materials for medium load purposes.

Silver-metal oxide composite materials have been heretofore produced by the methods in which a silver alloy containing one or more other metals to be oxidized is internally oxidized, or a silver powder and a powder of an oxide of other metals are sintered by power metallurgy.

According to the above internal oxidation method, a silver-other metals solid solution alloy is heated below its melting point under an increased partial pressure of oxygen so that oxygen may be diffused into the alloy, thereby the other metals which have a relatively high affinity for oxygen being precipitated as fine particles of oxides in a silver matrix. This method, however, has the disadvantages that the oxide content achieved in the composite material produced is limited to not more than about 4% by weight in terms elemental metal, and that the diffusion rate of oxygen into the solid solution alloy is so low that production of the composite material needs much time. To increase the oxide content above about 4% in terms of elemental metal or to increase the diffusion rate of oxygen, an element capable of promoting oxidation such as In and Bi is added prior to internal oxidation. Nevertheless, internal oxidation of an alloy with a thickness of, e.g., 2 mm takes about one month.

Moreover, according to internal oxidation, the amount of oxygen diffusing into a solid solution alloy decreases in adverse proportion to the square of the thickness of the layer from the surface which has been already oxidized, so that it is inevitable that oxide particles close to the surface become coarse, whereas an alloy phase containing a small amount of fine oxide particles forms in the core. Consequently, the silver-metal oxide composite material produced is non-uniform in the distribution of the oxide particles as well as in the size thereof. The particle size decreases with the depth. Since the oxide particles are non-uniform in size and segregate as described above, improvement in strength of the composite material obtained is limited; hence further improvement has been required.

In the production of a silver-metal oxide composite material according to powder metallurgy, a powder of an oxide of Sn, Cd, Zn or the like with good refractory properties and a silver powder are sintered at a temperature at which silver is solid. Therefore, strong binding is not achieved between the silver phase and the oxide particles; there remains fine spaces therebetween. Further defects existing in the crystal structure of the starting oxide are not repaired. Consequently, the sintered product obtained has a poor mechanical strength, particularly at a high temperature, which cannot be improved even by post-treatment such as hot extrusion or forging. To improve the silver-metal oxide composite material produced by powder metallurgy, the addition of W, Mo or the like that forms lower oxides is attempted, but it increases contact resistance and makes the resulting composite material susceptible to deposition where the material is used as an electrical contact material. The addition of MnO, CaO, ZrO or the like for improvement may be proposed, but it impairs sintering properties and therefore results in a lowering of the mechanical strength of the sintered products obtained.

SUMMARY OF THE INVENTION

It is, accordingly, an object of the present invention to provide a silver-metal oxide composite material in which fine particles of a particular element are bound to silver matrix compactly or with no space left and dispersed uniformly in the silver matrix, and a process capable of producing such a composite material in a relatively short time with a high productivity.

The present inventor has discovered that the oxygen diffusion rate in internally oxidizing a silver-another metal system can be increased by placing the system in a condition wherein a liquid phase and a solid phase coexist, and that a silver-metal oxide composite material can be obtained in which oxide particles formed are bound to silver matrix compactly or with no space left and dispersed uniformly in the silver matrix.

Silver-metal oxide composite material

Thus, the present invention provides a silver-metal oxide composite material comprising a silver matrix, (a) from 1 to 20% by weight, in terms of elemental metal, of an oxide of at least one element selected from the group consisting of Sn, Cd, Zn and In and, optionally, (b) from 0.01 to 8% by weight, in terms of elemental metal, of an oxide of at least one element selected from the group consisting of Mg, Zr, Ca, Al, Ce, Cr, Mn and Ti and/or (c) from 0.01 to 8% by weight, in terms of elemental metal, of an oxide of at least one element selected from the group consisting of Sb, Bi and iron family metals such as Fe, Ni and Co; the oxide of the (a) element and, where present, the oxide of the (b) element and/or the oxide of the (c) element being dispersed in the form of fine particles with a particle size of not more than about 0.1 μm uniformly throughout the silver matrix from the surface to the core thereof and being bound to the silver matrix with no space left between the oxides and the silver matrix.

In the composite material of the present invention, the oxide particles dispersed in the matrix normally have a hard and dense crystal structure.

In the silver-metal oxide composite material of the present invention, unlike the prior art composite materials produced by internal oxidation, the oxides are dispersed in the form of fine particles with a particle size of not more than about 0.1 μm uniformly throughout the silver matrix from the surface to the core thereof and are bound to the silver matrix compactly or with no space left; therefore the composite material is excellent in physical and chemical strengths, particularly at high temperatures. Although according to the internal oxidation, up to only about 4% by weight, in terms of elemental metal, of oxide can be incorporated in the composite material, the composite material of the present invention can contain almost unlimited amount of, but practically up to 50% by weight, preferably up to 36% by weight of oxides in terms of elemental metal, resulting in further improvement in strength.

Moreover, the conventional internal oxidation requires much time for completion of oxidation, and particularly can produce thick-wall composite products with difficulty; however, the process of the present invention described later, by contrast, can produce the above composite product even with thick walls or in a bulk block, within a markedly short time in high productivity.

DETAILED DESCRIPTION OF PREFERRED EMBODIMENTS

Figure 1:
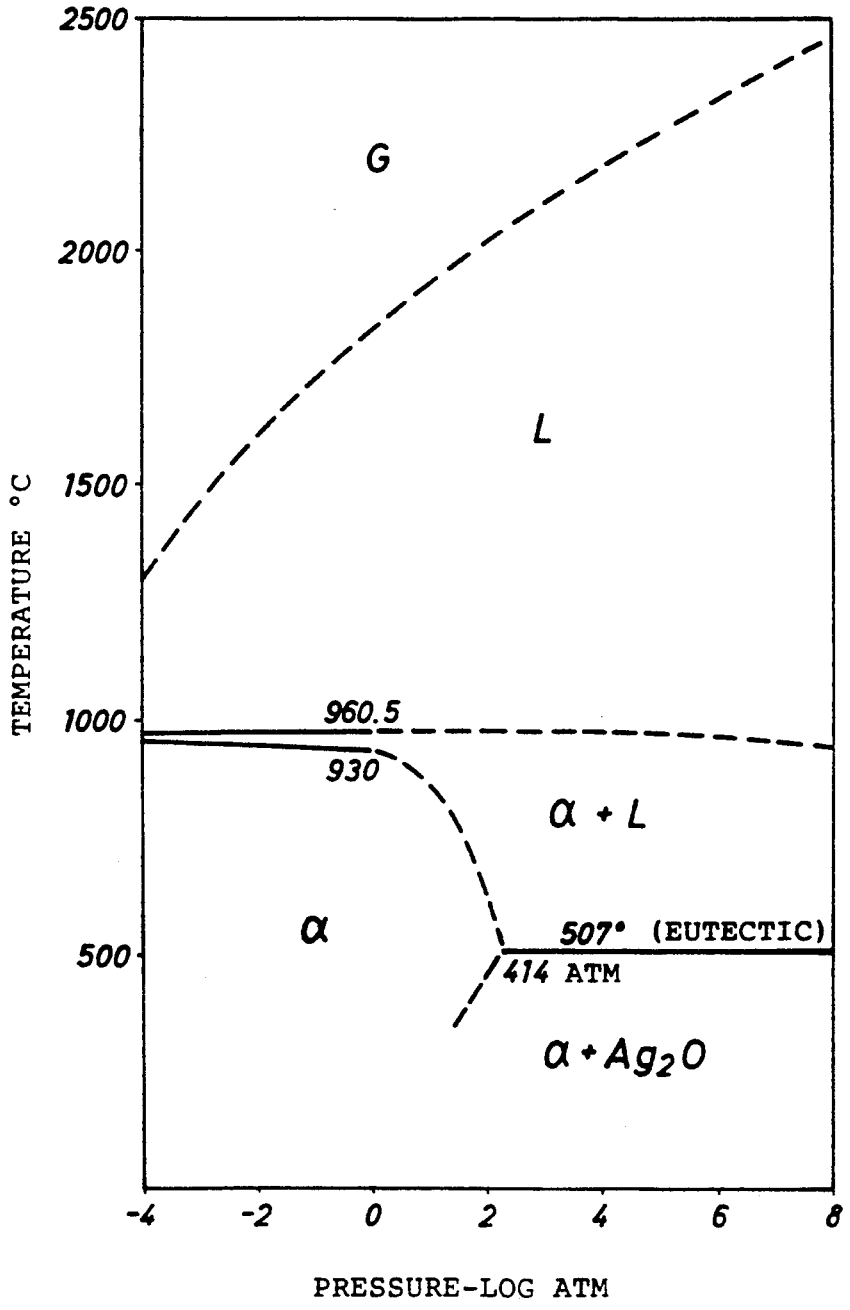
FIG. 1 shows a temperature vs. pressure phase diagram of silver-oxygen system.

Where the composite material of the present invention contains the oxide of said (b) element and/or the element of said (c) element in addition to the oxide of the (a) element, these oxides normally exist in the form of a compound oxide (or a combined oxide).

The composite material of the present invention has good strength at high temperatures, and is useful as an electrical contact material for relays, switches, breakers, and the like for alternating current and direct current. In particular, the composite material containing the oxide of the (b) element, which enhances the refractory properties of the composite material, is suitable as an electrode material for electric welding, for instance. The metals of the (c) element serve to promote oxidation of the elements to be oxidized in the process of production as described later, and form a combined oxide together with the (a) element and, where present, the (b) element, thus stabilizing effectively contact resistance in low current regions.

The composite material, as described above, may contain up to 50% by weight, preferably up to 36% by weight, of the oxide in total. Too large an amount of the oxides may impair electrical conductivity of the material.

The composite material of the present invention includes a variety of embodiments. In any of the embodiments, the oxide of the (a) element and, optionally, the oxide of said (b) element and/or the oxide of said (c) element are dispersed in silver matrix uniformly in the state as described above.

In the first embodiment of the composite material, the composite material essentially consists of the silver matrix and from 1 to 20% by weight, in terms of elemental metal, of an oxide at the (a) element.

In the second embodiment of the composite material, the composite material essentially consists of silver matrix, (a) from 1 to 20% by weight, in terms of elemental metal, of an oxide of at least one element selected from the group consisting of Sn, Cd, Zn and In, and (b) from 0.01 to 8% by weight, in terms of elemental metal, of an oxide of at least one element selected from the group consisting of Mg, Zr, Ca, Al, Ce, Cr, Mn and Ti, wherein the oxides of (a) and (b) form a compound oxide.

In the third embodiment of the composite material, the composite material essentially consists of silver matrix, (a) from 1 to 20% by weight, in terms of elemental metal, of an oxide of at least one element selected from the group consisting of Sn, Cd, Zn and In, and (c) from 0.01 to 8% by weight, in terms of elemental metal, of an oxide of at least one element selected from the group consisting of Sb, Bi and iron family metals, wherein the oxides of (a) and (c) form a compound oxide.

In the fourth embodiment of the composite material, the composite material essentially consists of silver matrix, (a) from 1 to 20% by weight, in terms of elemental metal, of an oxide of at least one element selected from the group consisting of Sn, Cd, Zn and In, (b) from 0.01 to 8% by weight, in terms of elemental metal, of an oxide of at least one element selected from the group consisting of Mg, Zr, Ca, Al, Ce, Cr, Mn and Ti, and (c) from 0.01 to 8% by weight, in terms of elemental metal, of an oxide of at least one element selected from the group consisting of Sb, Bi and iron family metals, wherein the oxides of the (a), (b) and (c) elements form a compound oxide.

In the second to fourth embodiments above, the compound oxide formed is dispersed in the form of fine particles with a particle diameter of not more than about 0.1 μm uniformly throughout the silver matrix from the surface to the core thereof and is bound to the silver matrix compactly or with no space left between the particles and the matrix.

Process for producing silver-metal oxide composite oxide

According to the process of the present invention, a starting material containing silver and the (a) element and, optionally, the (b) element and/or the (c) element is placed in a state in which a liquid phase and a solid phase coexist. In such a state a part of the system is present in a liquid phase, which serves as of a good passage through which oxygen is conveyed. Therefore, markedly rapid diffusion of oxygen is achieved as compared with the conventional internal oxidation, so that oxidation proceeds within a relatively short time uniformly from the surface to the core parts.

Thus, the silver-metal oxide composite material of the present invention can be produced by a process comprising the steps of:

(A) raising the partial pressure of oxygen and heating therein a mixture comprising silver, (a) from 1 to 20% by weight, in terms of elemental metal, of at least one element selected from the group consisting of Sn, Cd, Zn and In in a metallic and/or oxide state and, optionally, (b) from 0.01 to 8% by weight, in terms of elemental metal, of at least one element selected from the group consisting of Mg, Zr, Ca, Al, Ce, Cr, Mn and Ti in a metallic and/or oxide state and/or (c) from 0.01 to 8% by weight, in terms of elemental metal, of at least one element selected from the group consisting of Sb, Bi and iron family metals such as Fe, Ni and Co in a metallic and/or oxide state to thereby bring the mixture into a state where a solid phase and a liquid phase coexist, whereby the (a) element in a metallic state, and the (b) element and/or the (c) element in a metallic state, where present, are precipitated as oxides, and (B) lowering the partial pressure of oxygen and cooling the mixture.

The mixture used as a starting material in the step (A) may be in the form of, for example, an alloy or a sintered product produced by powder metallurgy of silver, said (a) element and, optionally, said (b) element and/or said (c) element which are added as necessary. The element of said (b) has a high affinity for oxygen and effectively allows fine oxide particles to be precipitated, thereby serving to improve the refractory properties of the composite material. Although a starting mixture containing the (a) element in a relatively small amount but containing the (b) element in a relatively large amount is generally difficult to oxidize, the process of the present invention can readily proceed with oxidation of such a starting material, producing a composite material having good refractory properties suited to electrode materials for electric welding. The (c) element is effective for promoting oxidation.

The sintered product which may be used as the starting mixture includes, for example, a sintered product produced from a silver powder and a powder of alloy of silver, the (a) element and, optionally, the (b) element and/or the (c) element.

The sintered product which may be used as the starting mixture also includes a sintered product produced from a silver powder and a powder of alloy of the (a) element and, the (b) element and/or the (c) element.

Preferably, in practicing the above process, the mixture which is an alloy or a sintered product is covered with silver or a silver-based alloy containing other metal components than silver in a small amount of less than 1% by weight. This is because when a high partial pressure of oxygen is applied to a silver mixture containing 5 to 20% by weight of the (a) element, an oxide such as, e.g., $SnO_2$ may accumulate in the surface layer, thereby interfering with permeation or penetration of oxygen into the inside of the mixture. To prevent such interference, it is required to increase oxygen partial pressure gradually up to a desired value, which results in necessity of long time for oxidation treatment. However, if the mixture is covered as described above in advance, the accumulation of the oxide in the surface layer can be prevented, and therefore treatment can be started with a desired oxygen partial pressure from the beginning. This is advantageous in completing oxidation within a short time.

In the process, use of a silver mixture essentially consisting of from 1 to 20% by weight of the (a) element and, as the rest, silver, for the starting mixture gives the composite material of said first embodiment.

In the process, use of a silver mixture essentially consisting of from 1 to 20% by weight of the (a) element, from 0.01 to 8% by weight of the (b) element and, as the rest, silver, for the starting mixture gives the composite material of said second embodiment. If the system is placed in the condition wherein a liquid phase and a solid phase coexist until the whole of the metals of (a) and (b) precipitate as the oxides with the progress of oxidation.

In the process, use of a silver mixture essentially consisting of from 1 to 20% by weight of the (a) element, from 0.01 to 8% by weight of the (c) element and, as the rest, silver, for the starting mixture gives the composite material of said third embodiment. If the system is placed in the condition wherein a liquid phase and a solid phase coexist until the whole of the metals of (a) and (c) precipitate as the oxides with the progress of oxidation.

Further, in the process, use of a silver mixture essentially consisting of from 1 to 20% by weight of the (a) element, from 0.01 to 8% by weight of the (b) element, from 0.01 to 8% by weight of the (c) element and, as the rest, silver, for the starting mixture gives the composite material of said fourth embodiment. If the system is placed in the condition wherein a liquid phase and a solid phase coexist until the whole of the metals of (a), (b) and (c) precipitate as the oxides with the progress of oxidation.

In the process of the present invention, a part or whole of each of the (a) element and, optionally, the (b) element and/or the (c) element contained in the starting mixture used in the step (A) may be present as a particle of an oxide having a particle size of not more than about 0.1 μm.

Accordingly, the process of the present invention includes, as a further embodiment, one in which said starting mixture used in the step (A) is a sintered product produced from a silver powder, a powder of an oxide of the (a) element having a particle size of not more than about 0.1 μm and, optionally, a powder of an oxide of the (b) element having a particle size of not more than about 0.1 μm and/or a powder of an oxide of the (c) element having a particle size of not more than about 0.1 μm.

In the case of this embodiment, the oxide of the (a) element and, optionally, the oxides of the (b) element and/or the (c) element to be dispersed in the silver matrix are provided previously in the form of oxide powders having a particle size of not more than about 0.1 μm. If the sintered product is placed in the condition in which a part of the system become a liquid phase, fine spaces which may be present among or around the silver particles and the oxide particles are filled with the liquid phase, and a dense or compact structure with no space left is thereby achieved. Consequently, the strength of the composite material obtained is improved.

In the embodiment of the process, use of a sintered product produced from a silver powder and from 1 to 20% by weight, in terms of elemental metal, of a powder of the an oxide of the (a) element, as said sintered product gives the composite material of said first embodiment.

In the embodiment of the process, use of a sintered product produced from a silver powder, from 1 to 20% by weight, in terms of elemental metal, of a powder of the (a) element and from 0.01 to 8% by weight, in terms of elemental metal, of a powder of the oxide of the (b) element, as said sintered product gives the composite material of said second embodiment.

In the embodiment of the process, use of a sintered product produced from a silver powder, from 1 to 20% by weight, in terms of elemental metal, of a powder of the (a) element and from 0.01 to 8% by weight, in terms of elemental metal, of a powder of the oxide of the (c) element, as said sintered product gives the composite material of said third embodiment.

In the embodiment of the process, use of a sintered product produced from a silver powder, from 1 to 20% by weight, in terms of elemental metal, of a powder of the (a) element, from 0.01 to 8% by weight, in terms of elemental metal, of a powder of the oxide of the (b) element, and from 0.01 to 8% by weight, in terms of elemental metal, of a powder of the oxide of the (c) element, as said sintered product gives the composite material of said fourth embodiment.

FIG. 1 shows the temperature vs. pressure phase diagram of the silver-oxygen system. In the case where the starting mixture of the process of the present invention contains the (a) element and, optionally, the (b)

element and/or the (c) element in a metallic state, the phase diagram will be changed to some extent. However, the phase diagram of FIG. 1 is helpful for understanding the process of the present invention. When the starting mixture is placed in a state in which a liquid phase and a solid phase coexist (the region indicated as $\alpha+L$ in FIG. 1, permeation or penetration of oxygen into the system can take place with ease by the external oxygen pressure, because silver is partly in the form of a liquid phase. The diffusion rate of the oxygen is markedly large as compared with the case where oxygen diffuses into a solid solution in the conventional internal oxidation. As oxygen is conveyed through the liquid phase, the (a) element, the (b) element and/or the (c) are element oxidized, where present in the form of elemental metal. The oxidation proceeds from the surface of the system. For example, where tin is present, from the liquefied silver-tin solution, tin is oxidized to precipitate as fine tin oxide ($SnO_2$) particles with the progress of oxidation, with a pure silver phase being left. Presumably, such reaction proceeds successively from the surface toward the core, and finally produce a state wherein the fine tin oxide particles are dispersed uniformly throughout the system.

Since the temperature vs. pressure phase diagram is different depending on the presence or absence of the (a) element, the (b) element and/or the (c) element as well as their contents, the temperature and the partial pressure of oxygen where a liquid phase appears cannot be generally specified. However, it is easy for those skilled in the art to find such temperature and pressure for any system, because if temperature and pressure are raised for any starting mixture, the system will transfer from a state where only a solid phase exists to a state where a solid phase and a liquid phase coexist. If even a part of the system is liquefied, the diffusion rate of oxygen markedly increases. Hence, as long as a liquid phase exists, a relatively low pressure and low temperature are sufficient, and such relatively mild conditions are advantageous with respect to consumption of energy. Although the solid and liquid phases coexist in a wide region on a phase diagram (especially, there is no upper limitation on oxygen partial pressure for a certain temperature range), it is practical to carry out the process of the present invention by finding a state where the both phases coexist in a temperature range of from 350° C. to 830° C. and in an oxygen partial pressure range of from 100 to 450 atm.

There is no limitation on the method for bringing the starting mixture to the state of target temperature and pressure. For example, it may be carried out by first adjusting temperature to a target value and then controlling oxygen partial pressure to a target value, whereby the system is transferred from the $\alpha$ region to the $\alpha+L$ region. Alternatively, it may be carried out by first raising oxygen partial pressure to a target value and then raising temperature up to a target value; thereby the system is transferred from the $\alpha+Ag_2O$ region to the $\alpha+L$ region.

EXAMPLES

The present invention will now be described in detail with reference to working examples and comparative examples.

Examples 1 to 12

Test specimen of each Example was prepared by any of the following methods. The composition and the preparation method of the test specimen for each Example is given on Table 1.

Method A: silver alloy containing a predetermined amount of other metals, backed with a pure silver layer with 1/10 thickness was rolled into a sheet 1 mm thick by the conventional hot rolling method, followed by cutting out to produce a disc measuring 4.5 mm in diameter and 1 mm in thickness. The disc was plated with silver in a thickness of 3 μm on its whole surfaces by the barrel silver plating method to prepare a test specimen.

Method B: The melt of a silver alloy containing other metals in a predetermined amounts, was cast in a hole with a diameter of 4.5 mm and a depth of 1.0 mm provided on a carbon plate mold, followed by cooling with a metallic mold, to produce a disc measuring 4.5 mm in diameter and 1 mm in thickness. The disc was plated with silver in a thickness of 3 μm on its whole surfaces by the barrel silver plating method to prepare a test specimen.

Method C: The melt of a silver alloy containing a high proportion of tin was atomized into nitrogen gas to form a powder of the alloy. The sliver-tin alloy powder obtained was mixed with a silver powder at a predetermined proportion, followed by grinding with a vibration mill. The resulting mixed powder was molded under pressure of 1 ton to form a disc measuring 4.5 mm in diameter and 1.1 mm in thickness. The green compact obtained was preliminarily sintered by holding it at 750° C. for 1 hour in a nitrogen atmosphere, followed by remolding to produce a test specimen measuring 4.5 mm in diameter and 1.0 mm in thickness.

Method D: The melt of an intermetallic compound containing a high proportion of tin was atomized into nitrogen gas to form a powder. The powder obtained was mixed with a silver powder so as to contain predetermined amounts of tin and the other metals, followed by grinding with a vibration mill. The resulting mixed powder was molded, preliminarily sintered and then remolded in the same manner as described for Method C to produce a test specimen.

Method E: A silver powder, a tin oxide powder and, if necessary, one or more powders of oxides of other metals were mixed so as to contain each of the components in a predetermined amount in terms of elemental metal, followed by grinding with a vibration mill. The resulting mixed powder was molded, provisionally sintered and then remolded in the same manner as described for Method C to produce a test specimen.

The test specimens of Examples 1 to 12 were placed in a heat-resistant vessel made of heat-resistant stainless steel, which was then hermetically sealed. The test specimens were heated up to 510° C. in an oxygen stream, and then oxygen partial pressure was raised gradually to 414 atm., at which the test specimens were maintained for 8 hours. Subsequently, the test specimens were maintained at 500° C. and 500 atm. for 10 minutes. Thereafter, pressure was reduced and cooling was gradually conducted.

The test specimens thus treated were cut and observed to find that the oxide particles formed were dispersed uniformly throughout the specimens with no space between them and the matrix.

Examples 13 and 14

The test specimens of Examples 13 and 14 were prepared by Method A above. The compositions of the test specimens are given in Table 1. These test specimens were maintained at 700° C. and an oxygen partial pressure of 200 atm. for 5 hours. Subsequently, the pressure was raised to 350 atm. and maintained at this pressure for 10 minutes, and then reduced to 1 atm., followed by cooling.

Comparative Examples 1 and 2

Test specimens for Comparative Examples 1 and 2 prepared in the same manner as in Examples 13 and 14, respectively, were maintained under the conditions of 700° C. and an oxygen partial pressure of 30 atm. for 5 hours. The oxidation was recognized to stop at a depth not more than 1 mm from the surface. Therefore, it was considered that complete oxidation is impossible.

The test specimens treated as described above in the above Examples 1–14 were measured for hardness and electrical conductivity. The results are given in Table 1.

Further, each of the test specimens of Examples 1–14 was brazed to a contact-support ally using silver solder with a composition of Ag-15% In-13% Sn (by weight) for conducting the following electrical tests.

1) Switchinq test

Switching test was conducted under the conditions of overload using an ASTM tester. Namely, the test was conducted under the conditions of an alternating voltage of 200 V, a current of 50 A, a power factor of 0.28, a switching frequency of 60/min., a contact load of 400 gf./set, a breaking force of 600 gf. and number of switching of 30,000, provided that when abnormal wastage or deposition was recognized, the test was stopped. The wasted amount of the test specimen used as a contact was measured, and the state of the surface of the tested specimen was observed visually.

2) Deposition test

The maximum value of current at which the contact is resistant to deposition was measured by producing currents using discharge of a chargeable condenser. The peak value of current discharged by the condenser was increased successively, by 500 A at a time. Deposition was considered to had taken place when the contact pressure exceeded 500 gf./set, and the force necessary for breaking the contact exceeded 1500 gf.

The results are given in Table 2.

TABLE 1

| Examples | Preparation method | Amounts of metals other than silver, % by weight | Hardness H.R.F *1 | Conductivity I.A.C.S % *2 |
|---|---|---|---|---|
| 1 | A | Sn 6 | 98 | 71 |
| 2 | A | Sn 10 | 104 | 69 |
| 3 | B | Sn 7.5, Ca 2.5 | 101 | 66 |
| 4 | B | Sn 9, Mg 1 | 99 | 71 |
| 5 | C | Sn 13, Cr 0.1 | 103 | 65 |
| 6 | C | Sn 8, Mn 1.0 | 105 | 72 |
| 7 | D | Sn 7.5, Ca 2.5 | 108 | 71 |
| 8 | D | Sn 8, Mg 1 | 96 | 68 |
| 9 | E | Sn 8, Zr 1 | 97 | 72 |
| 10 | E | Sn 8, Cd 4 | 96 | 69 |
| 11 | A | Sn 8, In 4 Ni 0.1 | 94 | 68 |
| 12 | A | Cd 14, Sn 1.5 Zn 0.1 | 108 | 61 |
| 13 | A | Sn 9, Zr 0.3 Ni 0.1 | 98 | 68 |
| 14 | A | Sn 9, Cd 3 Mg 0.15 | 103 | 62 |

Remarks: *1 Hardness of Rockwell
*2 International Copper Standard

TABLE 2

| Examples | Wasted amount (mg) | Deposition test (A) | Surface state of contacts |
|---|---|---|---|
| 1 | 4.8 | 9,000 | Smooth |
| 2 | 5.6 | 11,000 | Smooth |
| 3 | 7.2 | 13,500 | Slightly irregular |
| 4 | 8.8 | 14,000 | Slightly irregular |
| 5 | 8.2 | 18,000 | Less silvery and smooth |
| 6 | 6.5 | 8,000 | Less silvery and smooth |
| 7 | 6.9 | 10,500 | Gray and smooth |
| 8 | 9.1 | 11,000 | Gray and smooth |
| 9 | 6.6 | 9,500 | Gray and smooth |
| 10 | 5.2 | 9,000 | Smooth |
| 11 | 8.4 | 11,000 | Gray and smooth |
| 12 | 9.2 | 12,000 | Gray and smooth |
| 13 | 9.3 | 13,000 | White and smooth |
| 14 | 6.1 | 10,000 | Gray and smooth |

Remarks: The contacts of the Examples exhibited small amounts of arc and short breaking times.

We claim:

1. A process for producing a silver-metal oxide composite material, comprising the steps of:
   (A) forming a mixture comprising silver, (a) from 1 to 20% by weight, in terms of elemental metal, of at least one element selected from the group consisting of Sn, Cd, Zn, and In in a metallic and/or oxide state and, optionally, (b) from 0.01 to 8% by weight, in terms of elemental metal, of at least one element selected from the group consisting of Mg, Zr, Ca, A., Ce, Cr, Mn and Ti in a metallic and/or oxide state and/or (c) from 0.01 to 8% by weight, in terms of elemental metal, of at least one element selected from the group consisting of Sb, Bi and iron family metals in a metallic and/or oxide state, and
   (B) heating said mixture to between about 350° C. and 830° C. while raising the partial pressure of oxygen to between about 100 atm and 450 atm to thereby bring said mixture into a state where a solid phase and a liquid phase coexist, whereby the (a) element in a metallic state, and the (b) element in metallic state where present, and/or (c) element in metallic state where present, are precipitated as oxides, and
   (C) lowering the partial pressure of oxygen and cooling the mixture.

2. The process according to claim 1, wherein the mixture used in the step (A) comprises an alloy consisting of silver, the (a) element and, optionally, the (b) element and/or the (c) element.

3. The process according to claim 1, wherein the mixture used in the step (A) comprises a sintered product consisting of silver, the (a) element and, optionally, the (b) element and/or the (c) element.

4. The process according to claim 3, wherein said sintered product is produced from a silver powder and a powder of an alloy of silver, the (a) element and, optionally, the (b) element and/or the (c) element.

5. The process according to claim 3, wherein said sintered product is produced from a silver powder and a powder of an alloy of the (a) element, and the (b) element and/or the (c) element.

6. The process according to claim 1, wherein the mixture used in the step (A) comprises a sintered product produced from a silver powder, (a) a powder of ana oxide of the (a) element and, optionally, a powder of an oxide of the (b) element and/or a powder of an oxide of the (c) element.

* * * * *